US005344227A

United States Patent [19]

Röck et al.

[11] Patent Number: 5,344,227

[45] Date of Patent: Sep. 6, 1994

[54] EXTENSION GUIDE ASSEMBLY FOR A DRAWER

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 938,136

[22] PCT Filed: Feb. 11, 1992

[86] PCT No.: PCT/AT92/00017

§ 371 Date: Oct. 8, 1992

§ 102(e) Date: Oct. 8, 1992

[87] PCT Pub. No.: WO92/13473

PCT Pub. Date: Aug. 20, 1992

[30] Foreign Application Priority Data

| | | | |
|---|---|---|---|
| Feb. 12, 1991 | [AT] | Austria | 297/91 |
| Jul. 9, 1991 | [AT] | Austria | 1367/91 |
| Dec. 11, 1991 | [AT] | Austria | 2457/91 |
| Dec. 11, 1991 | [AT] | Austria | 2458/91 |

[51] Int. Cl.[5] ..... A47B 88/06

[52] U.S. Cl. ..... 312/334.6; 312/334.33; 312/334.34

[58] Field of Search ..... 312/334.31, 334.12, 312/334.13, 334.15, 334.33, 334.34, 334.45, 334.46, 334.6

[56] References Cited

U.S. PATENT DOCUMENTS

| | | |
|---|---|---|
| 1,321,167 | 11/1919 | Voigt . |
| 2,331,529 | 10/1943 | Wolters et al. . |
| 2,614,022 | 10/1952 | Kurtzon . |
| 3,937,532 | 2/1976 | Hagen et al. . |
| 4,469,384 | 9/1984 | Fler et al. . |
| 4,712,927 | 12/1987 | Arrendiell et al. . |
| 4,728,200 | 3/1988 | Rock et al. . |
| 4,953,990 | 9/1990 | Wojcik . |
| 4,955,160 | 9/1990 | Rock . |

FOREIGN PATENT DOCUMENTS

| | | |
|---|---|---|
| 0219733 | 4/1987 | European Pat. Off. . |
| 0355914 | 2/1990 | European Pat. Off. . |
| 0363583 | 4/1990 | European Pat. Off. . |
| 0367274 | 5/1990 | European Pat. Off. . |
| 1814714 | 7/1970 | Fed. Rep. of Germany . |
| 2613775 | 10/1977 | Fed. Rep. of Germany . |
| 2721231 | 11/1979 | Fed. Rep. of Germany . |
| 3716923 | 12/1980 | Fed. Rep. of Germany . |
| 3516957 | 11/1986 | Fed. Rep. of Germany . |
| 225534 | 6/1943 | Switzerland . |
| 1290751 | 9/1972 | United Kingdom . |

*Primary Examiner*—Kenneth J. Dorner
*Assistant Examiner*—Gerald Anderson
*Attorney, Agent, or Firm*—Wenderoth, Lind & Ponack

[57] ABSTRACT

An extension guide assembly for use on a side of a drawer to guide movement of the drawer into and out of a furniture body includes a support rail to be attached to the furniture body, an extension rail to be attached to the drawer, and a central rail between the extension rail and the support rail. The central rail has a U-shaped transverse profile opening downwardly, and carriages are positioned within the profile of the central rail and support rolling bodies transferring the load of the drawer from the central rail to the support rail. Guide members or runners are disposed on top of the central rail between the central rail and the extension rail. The extension rail has a downwardly open U-shaped transverse cross section including an upper horizontal leg above the guide members, lateral vertical legs extending downwardly from opposite sides of the upper horizontal leg along respective sides of the guide members, and a lower horizontal leg extending from one of the vertical legs to a position beneath each guide member. Thereby the extension rail and drawer are prevented from being lifted from the guide members and the central rail.

23 Claims, 11 Drawing Sheets

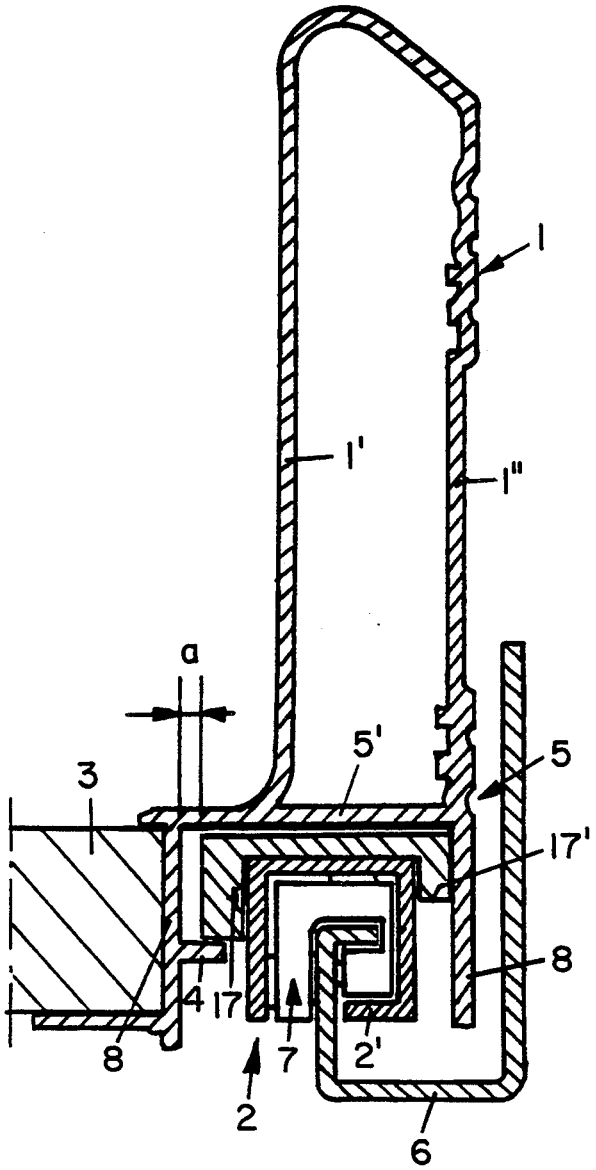
FIG. 1
FIG. 2
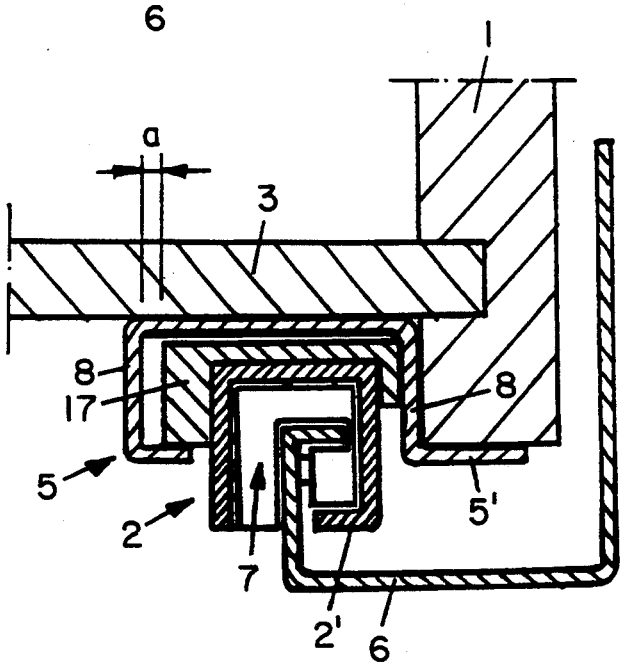

EXTENSION GUIDE ASSEMBLY FOR A DRAWER

The invention relates to an extension guide for drawers with a extension rail, attached to the drawer; a support rail, attached to the body of the furniture, and a central rail between both rails on each side of the drawer, wherein wagons are provided that hold the load-transferring rolling bodies and the central rails exhibit a bottom U profile in which the rollers in the wagons, transferring the load of the drawer from the central rails to the support rails, are guided.

There exist both socalled single extensions, where each side of the drawer exhibits only a drawer-sided extension rail and a body-sided support rail, and full extensions of the aforementioned kind, wherein each side of the drawer has another central rail between the extension rail and the support rail. A drawer provided with a single extension can be largely, but not totally pulled out of the body of the furniture, if said drawer is to remain anchored in the body of the furniture. The full extensions are more expensive in their construction, but allow the drawer to be completely pulled out, thus giving better access to the objects located at the rear end of the drawer.

Furthermore, extension guides are distinguished according to the kind of bearing for the rollers. There exist extension guides, where the load-transferring rollers are supported on the rails with axles; and there are extension guides, where the rollers and balls are supported in their own wagons between the rails. In the latter case the rollers or balls run differentially between the rails.

A full extension is known from the DE-A1 26 13 775, where both rollers supported on the central rails and rollers located in cages between the rails and are not supported on any rails are used. In so doing, the roller supported on the rail has the function of a carrier roller, which is to ensure that the rails are moved synchronously and thus the inner rail and the central rail reach the fully pushed in position at the same time.

Experience has shown that drawers provided with a full extension are usually not totally pulled out of the body of the furniture. This potential is to be given only in principle.

The object of the invention is to provide an extension guide that combines the two systems by an improved method so that an easy conversion from single extension to full extension is possible.

One embodiment of the invention provides that sliders for the load transfer from the extension rails to the central rails are disposed at the top at the central rails, and the extension rails exhibit a U profile with an additional bottom horizontal leg, which reaches under the sliders and forms a lift-off safety for the drawer.

It is provided advantageously that the sliders incorporated into the extension rails are narrower than the extension rails and allow the extension rails to be moved sideways.

One embodiment provides that the extension rails are part of a double walled drawer frame and are moulded to the inner wall of the drawer frame.

To prevent the drawer from tilting, it is provided advantageously that the space between the rollers or the sliders is greater than half the length of the extension rails.

Another embodiment provides that the drawer frame below the extension rail exhibits a wide region; and that in this wide region the central rail is incorporated. The central rail is covered totally by the drawer frame.

Another embodiment of the invention provides that at least one wagon is guided between the sliders on the central rails, whereby the diameter of the rollers supported therein is greater than the height of the sliders; and a carrier is provided between the central rails and the extension rails.

The extension guide of the invention functions in the rear region in turn as a single extension. The central rails are held at the extension rails and a relative movement occurs only between the central rails and the support rails.

To increase the reliability of such an extension guide and to ensure that a closed drawer is not opened unintentionally by jolts or the like and that in the first phase of the extension procedure the central rails are moved along with the extension rails, it is provided that a brake, which holds resiliently a pin or the like attached to the central rails, is disposed on the supports rails at the front and the rear and that a coupling is provided between the central rails and the extension rails.

It is advantageously provided that the brakes are formed by forked parts with two prongs that are resilient in one horizontal plane and of which the one prong is rigid and the other is resilient. Such brakes occupy little space vertically and can be attached so as to save space in an extension mounting disposed underneath the drawer bottom.

In the following embodiments of the invention are described in detail with reference to the Figures of the accompanying drawings.

FIGS. 1 and 2 are cross sectional views of a drawer frame and an extension guide on one side of the drawer.

Figure 14:
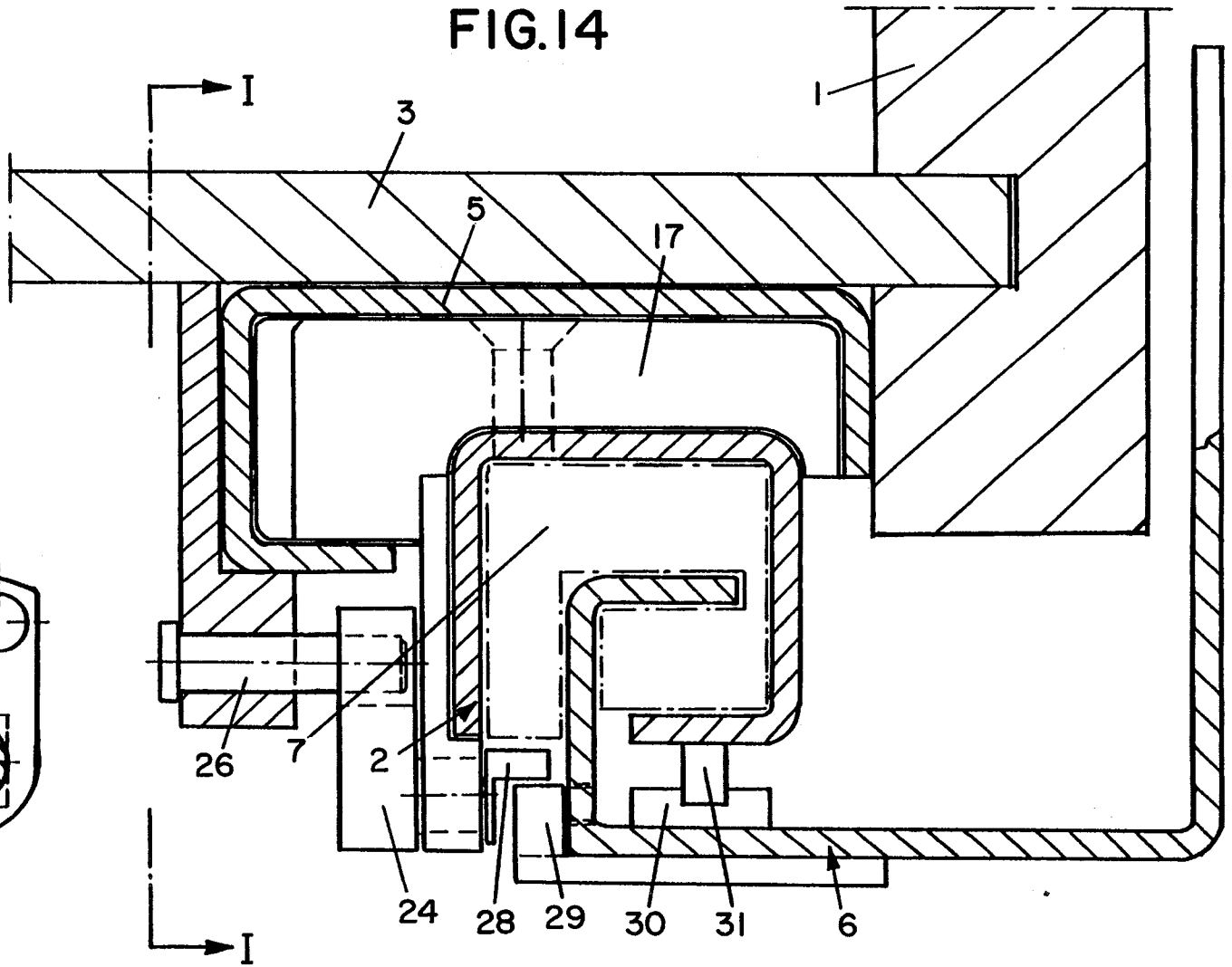
Figure 14A:
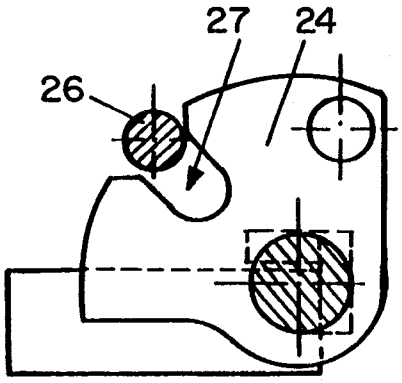

FIGS. 14 and **14*a*** are a cross sectional view of an extension guide in the corner region of a wood drawer.

Figure 15:
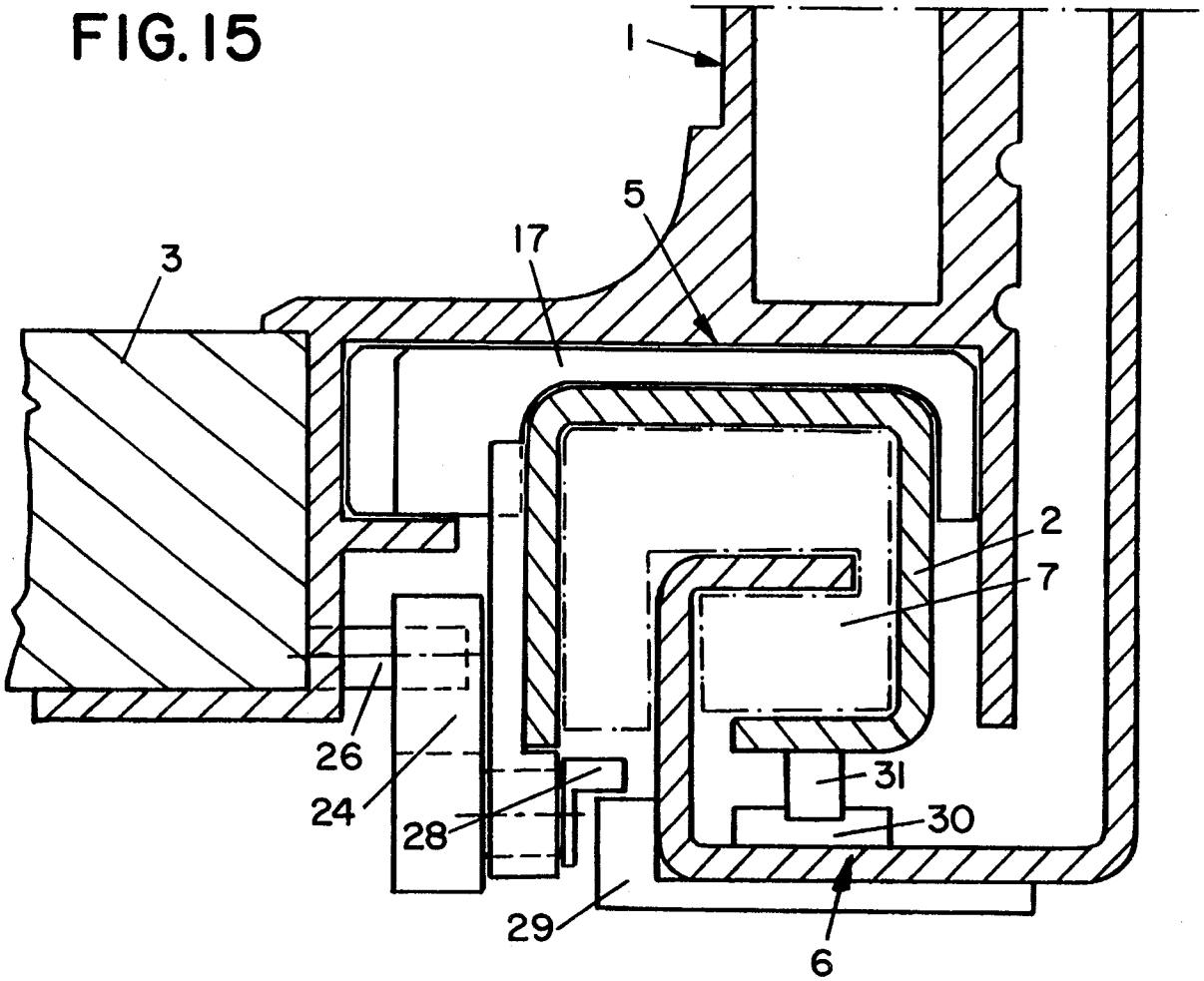

FIG. 15 is a cross sectional view of the extension guide according to the invention in the corner region of an aluminum frame.

Figure 16:
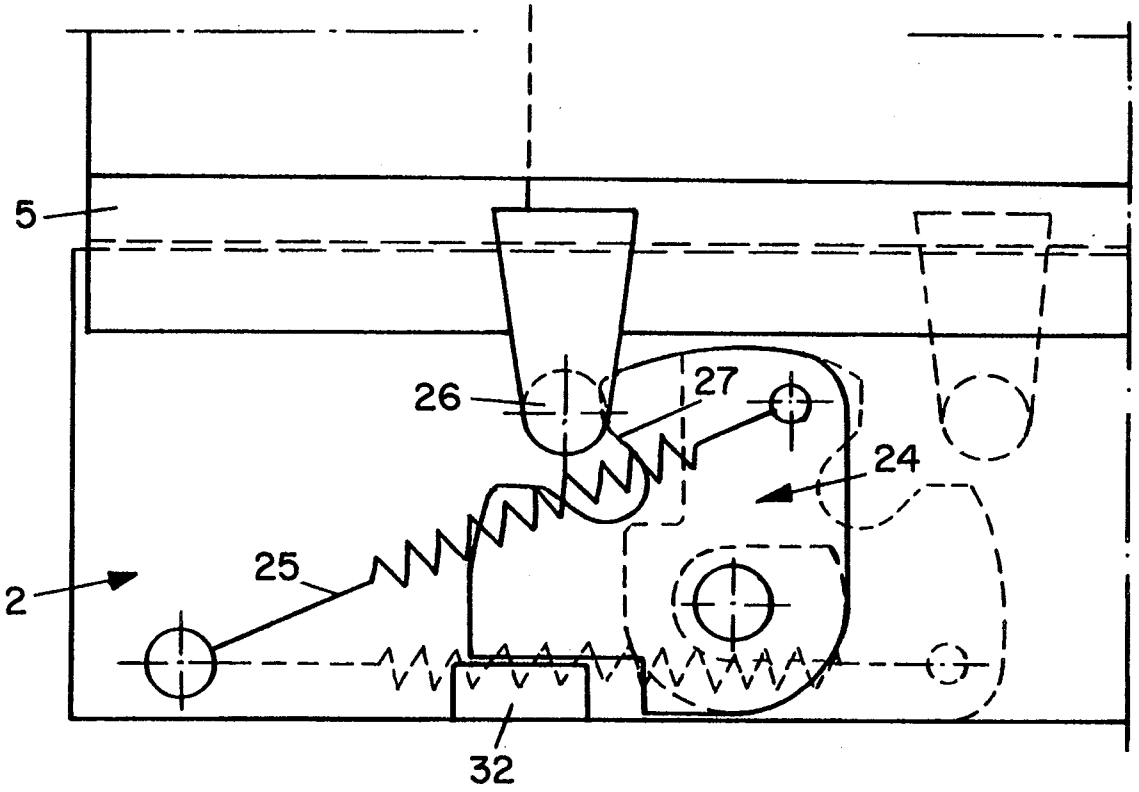

FIG. 16 is a side view of the catch according to the invention.

FIG. 1 shows a drawer with an aluminum frame.

The drawer bottom bears the reference numeral 3. The extension rail 5 is moulded directly to the drawer frame 1. The drawer frame 1 exhibits an inner wall 1' and an outer wall 1''. The extension rail 5 is located below the walls 1', 1'', where it is defined by an upper horizontal leg 4', a bottom horizontal leg 4, and lateral vertical legs 8. The central rail 2 is accommodated and at least partially covered by the extension rail 5.

The central rail 2 exhibits a U profile that is open at the bottom and half of which is covered by a bottom horizontal leg 2'.

The support rails bear the reference numeral 6.

A wagon 7, in which the load-transferring rollers or balls are embedded, is located between the central rails 2 and the support rails 6.

Two sliders 17 are mounted on the central rail 2.

One slider 17 is fixed on the front end of the central rail 2; the other sider 17 is located in the rear third of the central rail 2.

The extension rails 5 exhibit a U profile with a small bottom horizontal leg 4, which reaches under sliders 17.

A distance a of the one side compensation for the slider 17 is between the sliders 17 and the inner vertical leg 8 of the drawer, thus making it possible to move the drawer sideways.

In the embodiment, the two side of the central rail 2 is enveloped by slider 17, exhibiting the legs 17', which lie between the central rail 2 and the two vertical legs 8 of the extension rail 5 and snugly envelop the central rail 2.

The rear slider 17 is provided with a nub 13 projecting into a recess 14 in the extension rail 5.

If the drawer is pulled out of the body of the furniture, the central rails 2 travel with the extension rails 5, since they are held by the nubs 13. Not until the central rails have reached their front stop are the extension rails 5 moved relative to the central rails 2. The extension rails 5 can be moved over the nubs 13 with very little effort. This is further facilitated by the drawer tilting readily to the rear when it is pulled out to the front.

A wagon 9 is supported on the central rail between both sliders 17. In the wagon 9, which runs between the extension rail 5 and the central rail 2, there are rollers 10 mounted in series. On both sides of the central rail 2 the wagon 9 exhibits vertical legs 11 by means of which it is guided on the central rail 2. A tab, serving as the stop 12 for the wagon 9 and defining the travel of the wagon 9, is stamped out of the upper horizontal leg 2'' of the central rail 2.

The embodiment according to FIG. 2 shows the same extension guide fitting mounted on a wood drawer, where they are located below the drawer bottom 3 in the corner, which is defined by the drawer frame 1 and the drawer bottom 3. The extension rail 5 is attached directly to the drawer frame 1 by means of a leg 5'.

Since the diameter of the rollers 10 is somewhat greater than the height h of the sliders 17, the extension rail 5 travels on the rollers 10 and the sliders 17 serve merely as lift-off safety or as pivot safety for the extension rails 5 and thus for the drawer. In this manner it is facilitated that the extension guide fittings are readily accessible during service.

In the embodiment according to FIGS. 5 to 9, one brake 15, 16 each is mounted at the front and back on the support rail 6, and in particular on its bottom horizontal leg 6'. The brakes 15, 16 are plate-shaped and made preferably of plastic material. They are forked and exhibit a stationary prong 19 and a resilient prong 20.

The rear brake 16 exhibits a front oblique stop edge 21 and an edge, lying behind the same and extending approximately parallel to the vertical leg 6'' of the support rail 6 or being slightly inclined toward the rear, when the central rail 2 is moved in and the pin 22 of the central rail 2 is held by the brake 16.

On the one hand, the brake decelerates the central rail 2, when it is pushed with full force into the body of the furniture; and, on the other hand, it prevents the central rail 2 from travelling out unintentionally.

The springy leg 20 of the front brake 15 is provided with two oblique rising edges 23 and a notch 18.

If the central rail 2 is moved into its front final position or approximately into its front final position, the pin 22 of the central rail 2 locks in the notch 18. In this manner the central rail 2 is held even if slight pressure is exerted from behind, i.e. in the closing direction. This bears fruit especially when the drawer is to be anchored on the central rails 2. The drawer can be set on the central rails 2 and slid along them until an arresting device snaps shut. Not until then is more force exerted on the central rails 2 in the closing direction, resulting in the pin 22 in the notch 18 disengages and the central rails 2 moving freely to the rear.

Figure 4:
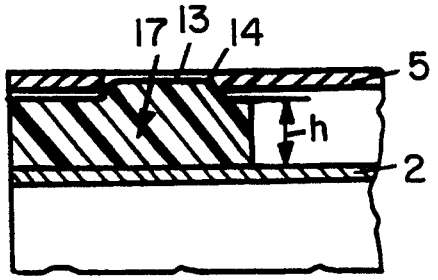
FIG. 4 is a vertical view of the extension rail and the central rail in the region of the front slider.
Figure 3:
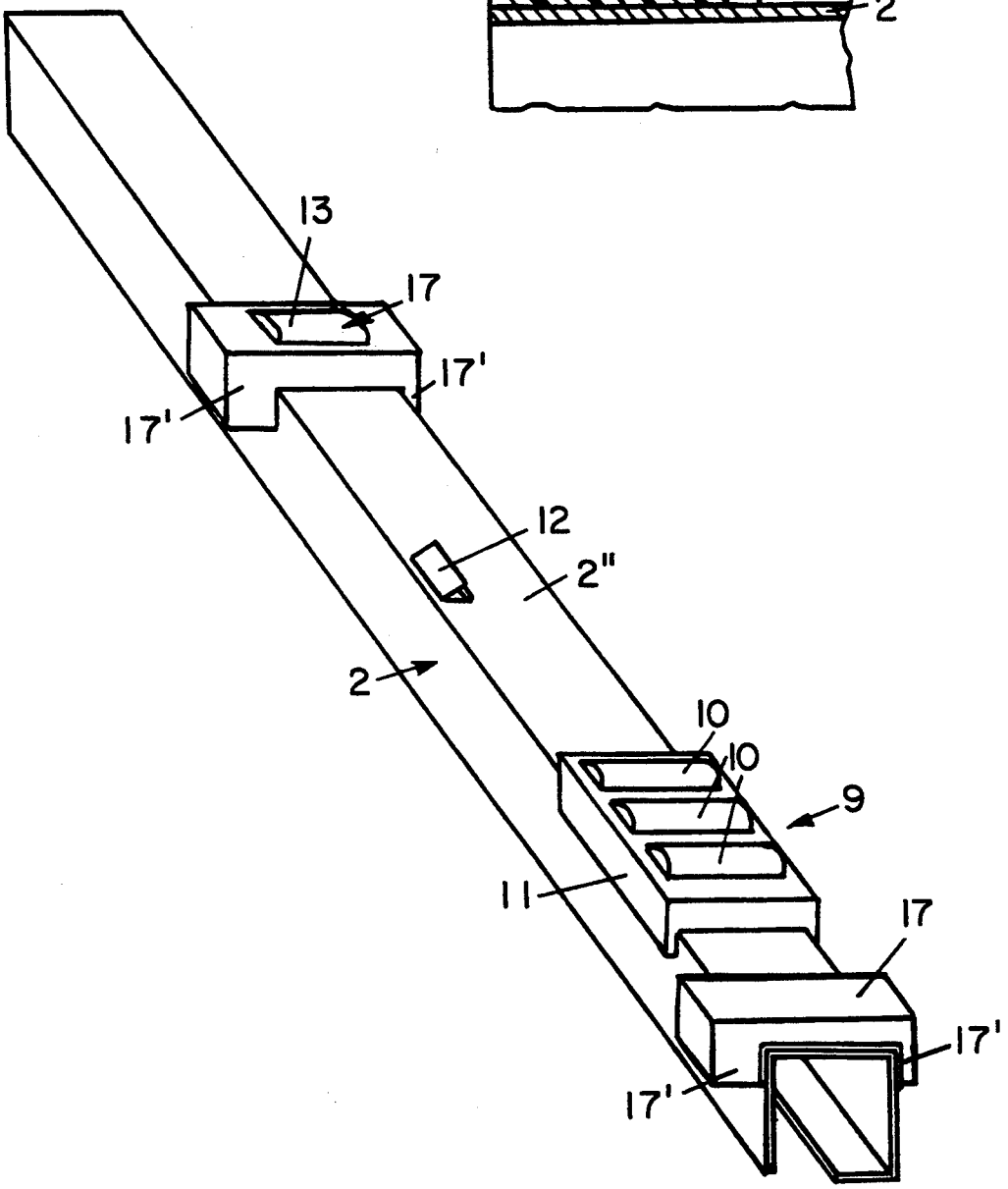
FIG. 3 is a diagram of the central rail with sliders and wagons.
Figures 5, 6, 7:
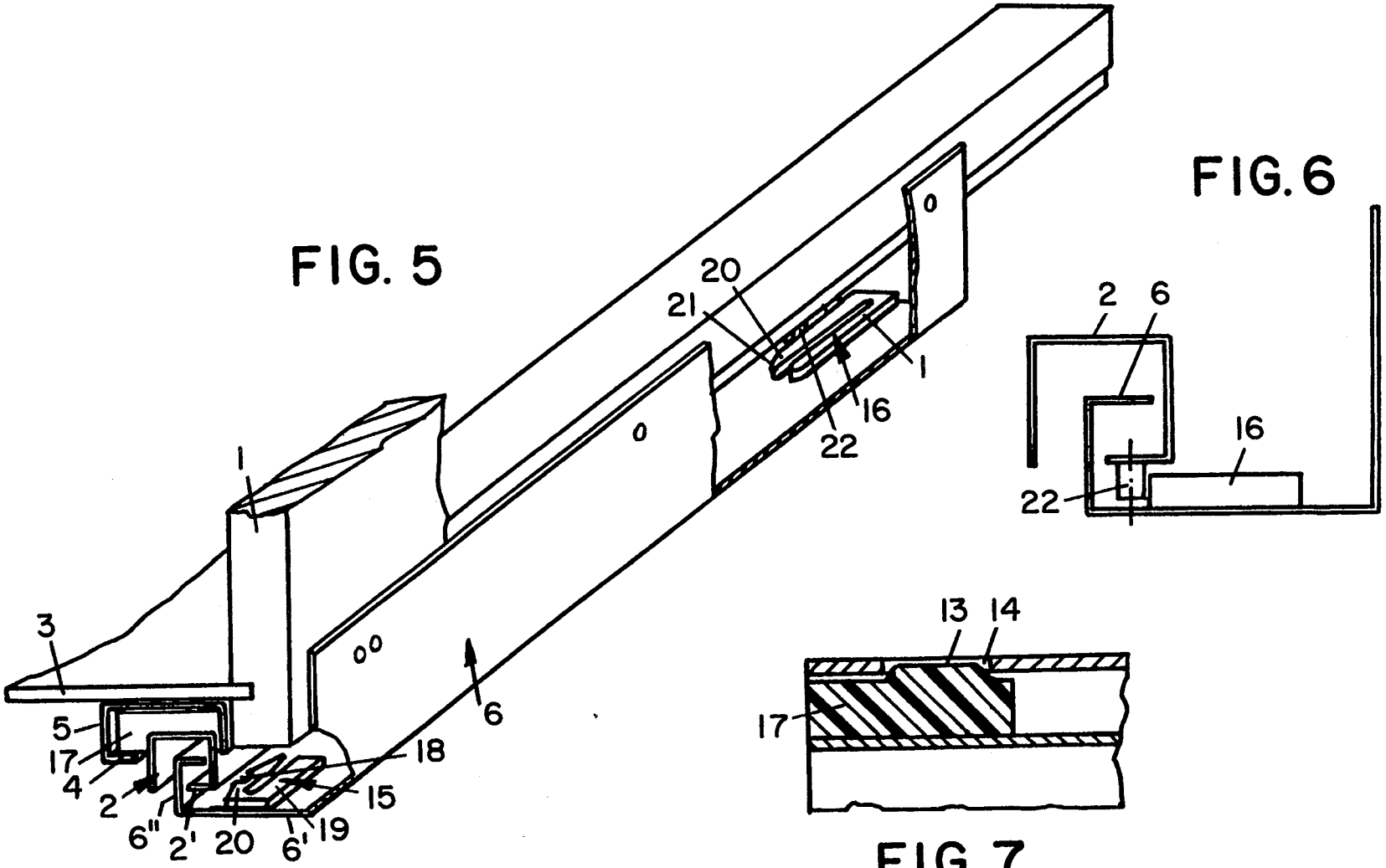
FIG. 5 is a diagram of another embodiment of an extension guide according to the invention, where in turn only parts disposed on one side of the drawer are shown.
FIG. 6 is a front view of the extension guide.
FIG. 7 is a vertical view of one segment of an extension rail and a central rail in the region of a slider.
Figure 8:
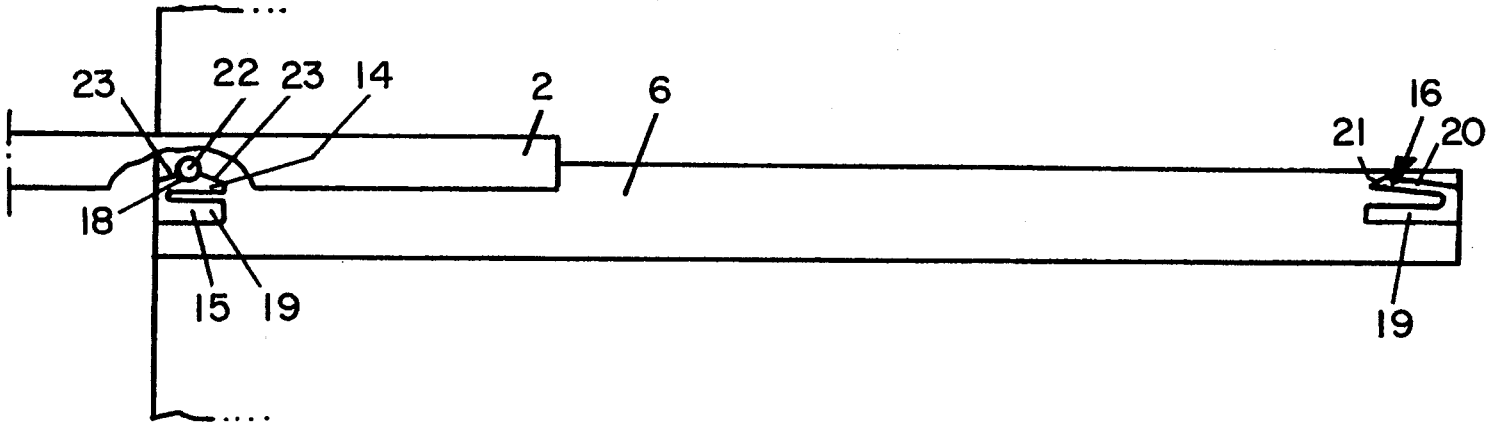
FIG. 8 is a top view of the body-sided support rail and the central rail with the drawer pulled out.
Figure 9:
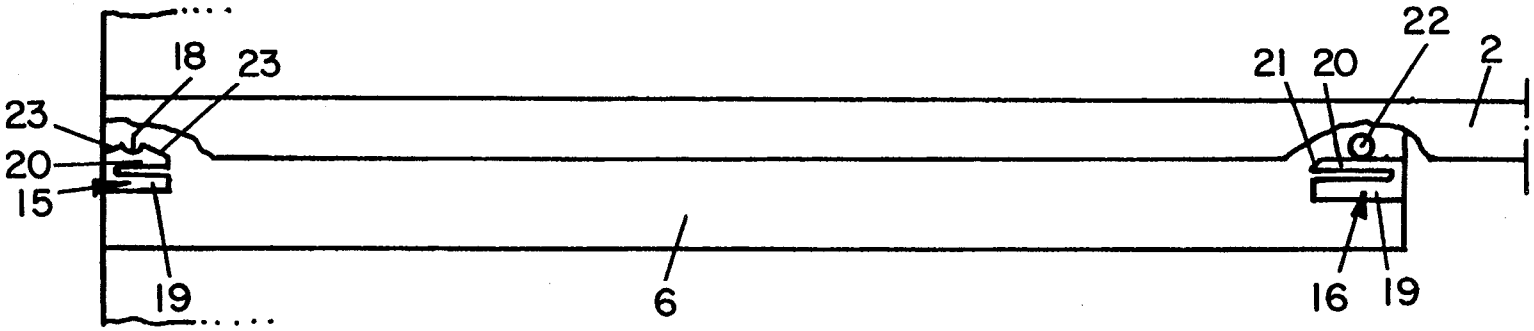
FIG. 9 is a top view of the support rail and the central rail with the drawer pushed into the body of the furniture.
Figure 10:
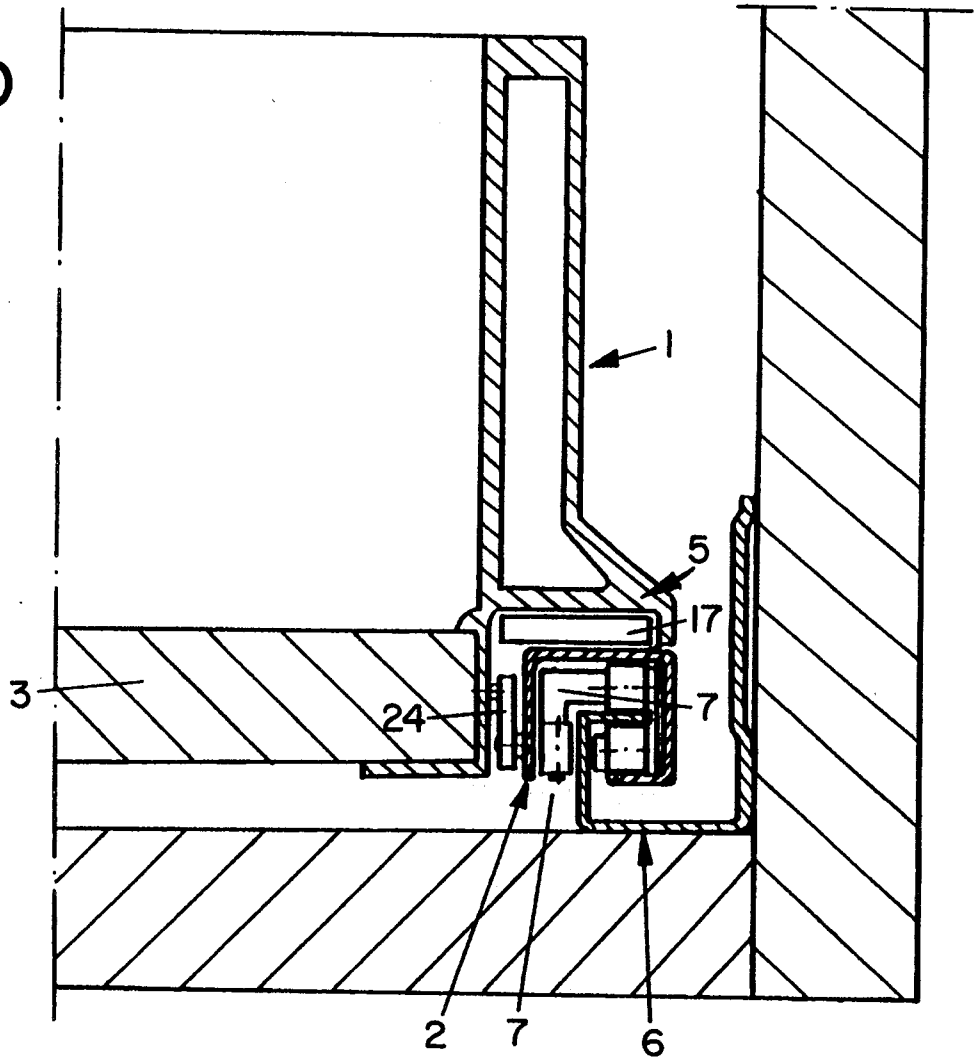
FIG. 10 is a schematic view of another embodiment of an extension guide according to the invention in the region of one side of the drawer.

As evident from FIG. 5, a bottom horizontal leg 4 of the extension rail 5 reaches under at least the front slider 17, thus resulting in a lift-off safety for the drawer.

Since, as noted above, the rollers 10 are much more readily accessible in the wagon 9, i.e. exert less friction than the slider 17, the central rail 2 is first pulled out of the body of the furniture with the extension rail 5, i.e. is moved along the support rail 6, when the drawer is pulled out of the furniture.

In this situation the extension guide according to the invention functions like a socalled single extension, i.e. a relative movement takes place only between two rails of the central rail 2 and the support rail 6.

If the central rail 2 has reached the front stop on the support rail 6, its further movement is impeded, while the extension rail 5 continues to move along the central rail 2 and in particular as far as its total extension potential. Thus, the extension guide of the invention is a true full extension, where the drawer can be completely pulled out of the body of the furniture, while it remains anchored in the extension guide. On the other hand, the extension guide of the invention functions in a first region like a socalled single extension, i.e. there is no relative movement between the extension rail 5 and the central rail 5. Both rails 2, 5 are moved together relative to the support rail 6.

To ensure this sequence of movement and that it depends not only on the varying friction between the sliders 17 and the rails 2, 5 and the rollers 10 of the wagon 4 between the rails 2, 6, a pivot segment 24 is provided in the embodiment according to FIGS. 10 to 16. The pivot segment 24 also ensures that, when the drawer is pushed into the body of the furniture, the extension rail 5 is moved first along the central rail 2, while the central rail 2 is held securely with respect to the support rail 6 and that subsequently the central rail 2 and the extension rail 5 are moved along the support rail 6 into the body of the furniture.

The tilt segment 24 is supported on the central rail 2 and is attached to it by means of a mounting.

As apparent from the Figures of the drawing, a spring 25, which can be both a pressure spring and an extension spring, engages with the pivot segment 24. The pivot segment 24 can be pivoted into two dead point positions. The two final positions are defined by the stops.

A carrier pin 26 is mounted on the extension rail 5 or on the drawer frame 1. The pivot segment 24 exhibits a slot 27, accommodating the carrier pin 26.

Figure 11:
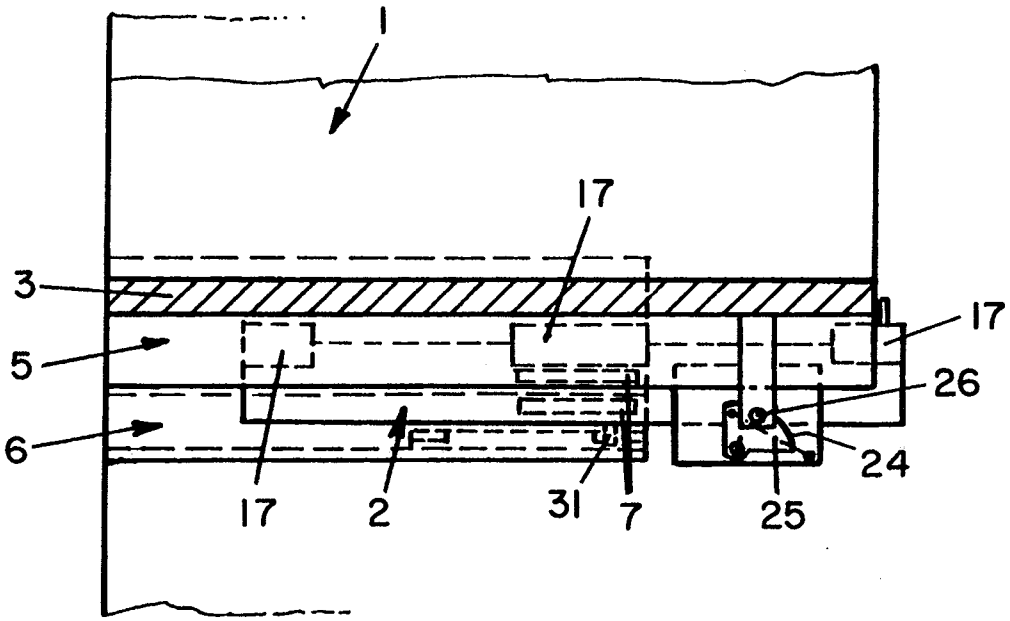
FIG. 11 is a partially fragmented side view of an extension guide according to the invention in the closed state.

When the drawer is closed, the pivot segment 24 is in the position shown in FIG. 11. The carrier pin 26 locks in the slot 27.

Figure 13:
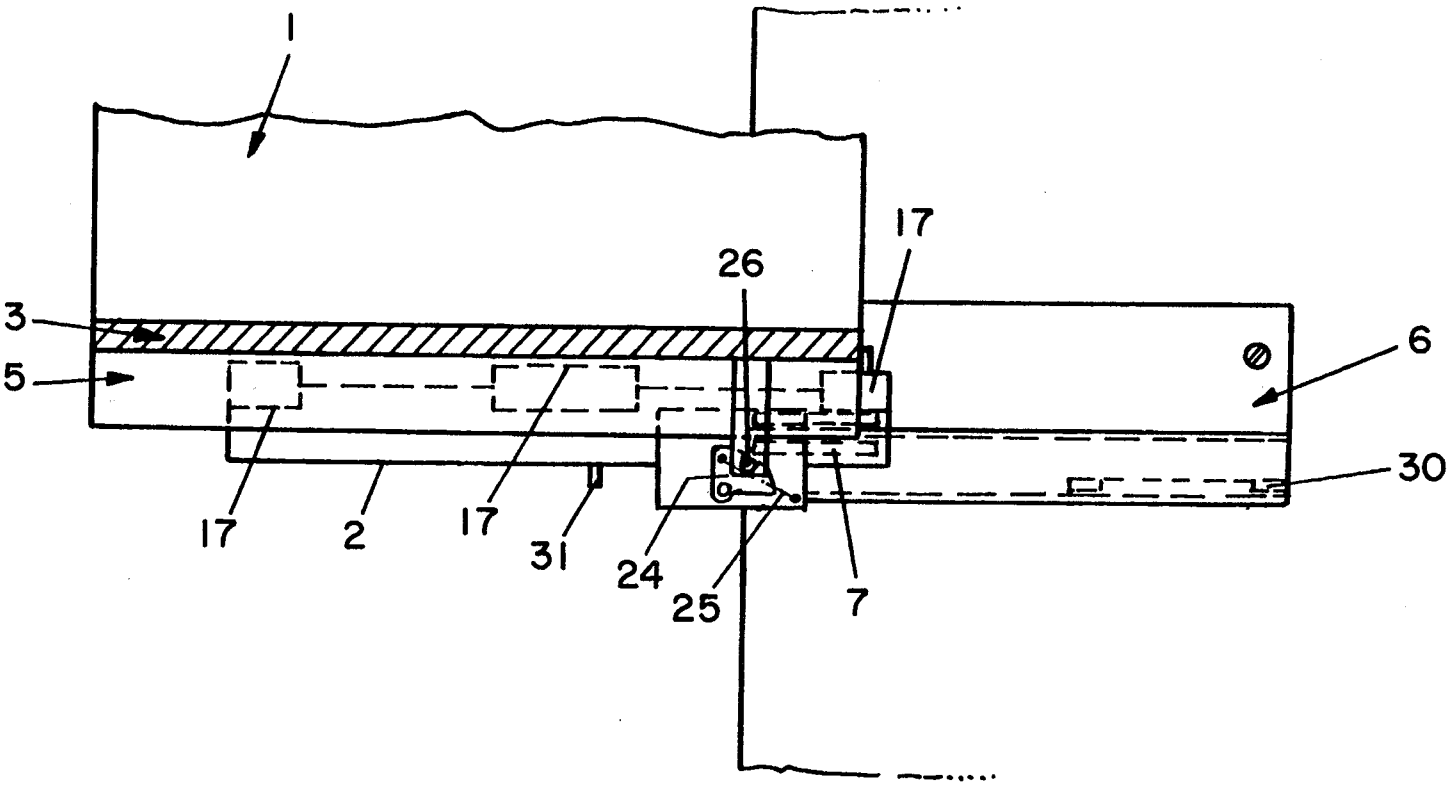
FIG. 13 is the same side view of the extension guide according to the invention in the semi pulled out state.

When the drawer is opened, the extension rail 5 and the central rail 2 are moved first, as explained above, with the pivot segment 24 remaining in its original position, as evident from FIG. 13. The spring 25 holds securely by way of the pivot segment 24 the extension rail 5 at the central rail 2.

If the central rail 2 reaches the front stop on the support rail 6, its further movement is blocked and the extension rail 5 is moved relative to the central rail 2. Thus, the pivot segment 24 is rotated further first against the spring action, whereby, on the one hand, the carrier pin 26 and thus the extension rail 5 are released and, on the other hand, a bolt element 28 moulded to the pivot segment 24 is moved in front of a stop 29 on the support rail 6. Interacting with the stop 29, the bolt element 28 prevents the central rail 2 from travelling back.

Figure 12:
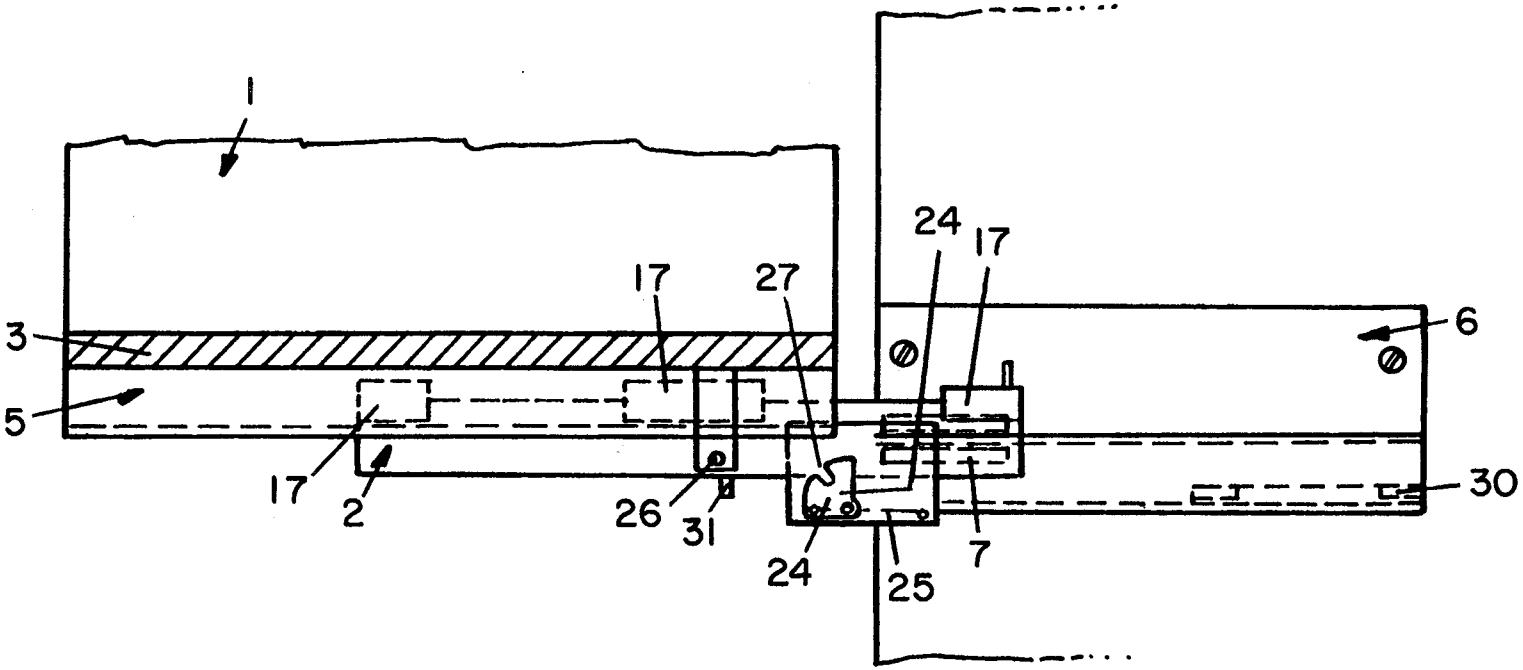
FIG. 12 is the same side view of the extension guide according to the invention in the totally pulled out state.

At this stage the pivot segment 24 is in the position shown in FIG. 12; and the extension rail 5 is in the sliding region, i.e. it can be moved freely on the central rail 2, while it is bolted with respect to the support rail 6.

If the extension rail 5 is moved with the drawer back into the body of the furniture, the carrier pin 26 reaches into the slot 27 of the pivot segment 24, whereby the pivot segment 24 is pivoted out of its dead point position and tipped over toward the bottom. On the one hand, the extension rail 5 is pulled in this manner to the rear stop on the central rail 2 and; on the other hand, the bolt element 28 is pivoted past the stop 29, so that the central rail 2 can be moved to the rear with respect to the support rail 6.

A pull-in device 30, which engages with a carrier pin 31 mounted on the central rail 2 and pulls the central rail 2 together with the extension rail 5 into the body of the furniture along the support rail 6 to the rear, is provided in the rear region of the support rail 6.

Such a pull-in device is described, for example, in the Austrian patent application A 2534/90 of the applicant.

To prevent the pivot segment 24 from tilting too far to the front, a stop 32 is provided on the central rail 2.

We claim:

1. An extension guide assembly for use on a side of a drawer to guide movement of the drawer into and out of a furniture body, said assembly comprising:

a support rail to be attached to the furniture body;

an extension rail to be attached to the drawer;

a central rail between said extension rail and said support rail, said central rail having a U-shaped transverse profile opening downwardly;

carriages positioned within said profile of said central rail and supporting rolling bodies transferring a load of the drawer from said central rail to said support rail;

guide members disposed on top of said central rail between said central rail and said extension rail;

said extension rail having a downwardly open U-shaped transverse cross section including an upper horizontal leg above said guide members, lateral vertical legs extending downwardly from opposite sides of said upper horizontal leg along respective sides of said guide members, and a lower horizontal leg extending from one said vertical leg to a position beneath each said guide member, thus preventing lifting of said extension rail and the drawer from said guide members and said central rail;

a pin on said extension rail; and a pivot member mounted on said central rail to pivot in opposite directions and biased by a spring to pivot, said pivot member having a slot receiving said pin in one direction of pivoting of said pin member, thereby preventing longitudinal movement of said extension rail relative to said central rail in said one direction of pivoting of said pivot member, said slot releasing said pin member in an opposite direction of pivoting of said pivot member, thereby allowing longitudinal movement of said extension rail relative to said central rail in said opposite direction of pivoting of said pivot member.

2. An assembly as claimed in claim 1, wherein said guide members are fixed to and immovable longitudinally of said central rail.

3. An assembly as claimed in claim 1, wherein said extension rail is formed in one piece with a double walled drawer frame of the drawer.

4. An assembly as claimed in claim 3, wherein said drawer frame and said extension rail together form an expanded region in which fits said central rail.

5. An assembly as claimed in claim 1, wherein each said guide member has a width less than a spacing between said vertical legs of said extension rail, thus enabling lateral movement of said extension rail relative to said central rail.

6. An assembly as claimed in claim 1, wherein a first said guide member is mounted at a front end of said central rail, and a second said guide member is mounted on said central rail at approximately a center of the length thereof.

7. An assembly as claimed in claim 1, further comprising a roller carriage mounted on top of said central rail for longitudinal movement relative thereto between said guide members.

8. An assembly as claimed in claim 7, wherein said roller carriage supports rollers having a diameter greater than a height of a portion of said guide members between said central rail and said extension rail.

9. An assembly as claimed in claim 8, wherein said rollers extend over substantially the entire width of said central rail.

10. An assembly as claimed in claim 7, further comprising a stop on said central rail between said guide members to limit movement of said roller carriage.

11. An assembly as claimed in claim 1, wherein one of said guide members has a projection extending into a recess in said extension rail.

12. An assembly as claimed in claim 11, wherein said one guide member comprises a rearmost guide member.

13. An assembly as claimed in claim 1, wherein each said guide member has a U-shaped configuration including legs on opposite sides thereof enclosing said central rail.

14. An assembly as claimed in claim 1, further comprising a catch on said central rail, and front and rear brakes mounted on said support rail for resiliently engaging said catch at respective end positions of movement of said central rail longitudinally of said support rail.

15. An assembly as claimed in claim 14, wherein each said brake comprises a forked member including a rigid prong and a resilient prong.

16. An assembly as claimed in claim 15, wherein said resilient prong of said front brake has therein a notch for retaining said catch.

17. An assembly as claimed in claim 14, wherein said brakes are formed by plastic plates.

18. An assembly as claimed in claim 1, wherein said pivot member includes a bolt to, upon said pivot member pivoting in said opposite direction, prevent movement of said central rail longitudinally relative to said support rail.

19. An assembly as claimed in claim 18, wherein said support rail has at a front end thereof a stop against which said bolt abuts when said pivot member pivots in said opposite direction.

20. An assembly as claimed in claim 1, further comprising a pull-in device mounted between said central rail and said support rail.

21. An assembly as claimed in claim 20, wherein said pull-in device is mounted on said support rail.

22. An assembly as claimed in claim 1, wherein said pivot member is pivotable over a dead center position.

23. An assembly as claimed in claim 22, further comprising stops on said central rail to define opposite end pivot positions of said pivot member.

* * * * *